United States Patent [19]

Hongo et al.

[11] Patent Number: 4,497,178

[45] Date of Patent: Feb. 5, 1985

[54] METHOD OF PREVENTING ATMOSPHERE FROM ENTERING HEAT-INSULATING CONTAINER

[75] Inventors: Akira Hongo, Miki; Hideki Ueda, Nagoya; Issei Nakata, Shizuoka; Eiichi Yoshida, Shimizu; Nobuyoshi Aoki, Shimizu; Toshimitsu Suzuki, Shimizu, all of Japan

[73] Assignees: Teisan Kabushiki Kaisha; Daiwa Can Company, Limited, both of Tokyo, Japan

[21] Appl. No.: 479,368

[22] Filed: Mar. 28, 1983

[30] Foreign Application Priority Data

Mar. 26, 1982 [JP] Japan ..... 57-47266

[51] Int. Cl.[3] ..... F17C 7/02

[52] U.S. Cl. ..... 62/55; 220/88 B

[58] Field of Search ..... 62/55, 45; 220/88 B

[56] References Cited

U.S. PATENT DOCUMENTS 3,306,061 2/1967 Scott et al. ..... 62/45
3,349,572 10/1967 Niemann ..... 62/55
3,350,890 11/1967 Cope ..... 62/45
3,352,123 11/1967 Ulbricht et al. ..... 62/55
3,359,745 12/1967 Basile et al. ..... 62/45
3,379,208 4/1968 Alleaume ..... 220/88 B
3,777,928 12/1973 Kober ..... 220/88 B

*Primary Examiner*—Ronald C. Capossela
*Attorney, Agent, or Firm*—James E. Nilles

[57] ABSTRACT

A method of preventing the atmosphere from entering a heat-insulating container adapted to temporarily reserve a low-temperature liquefied gas, wherein a dry gas is constantly supplied to the inside of the heat-insulating container when it is in an inoperative state, in order to maintain the inside of the heat-insulating container in a dry gas atmosphere having a pressure slightly higher than the atmospheric pressure. The dry gas is a vaporized gas of a low-temperature liquefied gas of the same kind as the low-temperature liquefied gas to be used. The dry gas is led out in the gas phase from a supply container for supplying the low-temperature liquefied gas to be used, or is a gas obtained by vaporizing a part of the low-temperature liquefied gas to be used, outside the supply container.

3 Claims, 1 Drawing Figure

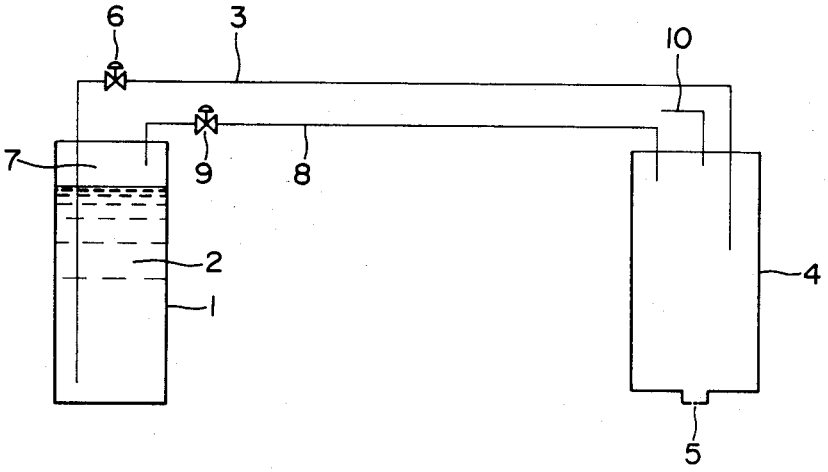
6
3
10
7
9
8
2
1
4
5

METHOD OF PREVENTING ATMOSPHERE FROM ENTERING HEAT-INSULATING CONTAINER

BACKGROUND OF THE INVENTION

1. Field of the Invention

The present invention relates to a method of preventing the atmosphere from entering a container in an inoperative state which is adapted to temporarily reserve therein a low-temperature liquefied gas, which is then supplied therefrom to an object through an outlet device such as a nozzle.

2. Description of the Prior Art

In use of a low-temperature liquefied gas such as liquid nitrogen, the gas is often supplied from a storage-supply source (e.g., a cold evaporator) to a heat-insulating container so as to be temporarily stored and then dripped or allowed to flow down through an outlet device such as a nozzle provided at the container. In such a usage, when the low-temperature liquefied gas is not used over a considerably long period of time, for example, a period from the end of one day's operation to the start of operation on the following day, i.e., when no low-temperature liquefied gas is supplied to the container from the storage-supply source, the container becomes empty. In consequence, the atmosphere enters the container through openings such as an outlet port of the outlet device and a gas discharge port of the container, and the moisture and carbon dioxide included in the atmosphere may cling, in the form of pieces of ice and frost, to the container inner wall and the outlet device surface which are cold. In the case where these ice pieces and the like are formed on the outlet device surface, as a matter of course, they will undesirably cause the outlet port to be blocked up, disturbing the flow of the low-temperature liquefied gas when it is used, or decreasing the flow rate. Also, in the case where these ice pieces and the like are formed on the container inner wall, when the low-temperature liquefied gas is supplied to the container, these ice pieces and the like are often suspended in the liquid to sink, causing the outlet port to be blocked up.

SUMMARY OF THE INVENTION

It is, therefore, an object of the invention to provide a method wherein the atmosphere is prevented from entering the heat-insulating container by constantly supplying a dry gas to the inside of the empty container when it is in an inoperative state, in order to prevent the formation of ice pieces and the like which cause the above-mentioned troubles, thereby eliminating the problems of the prior art.

To this end, according to the invention, there is provided a method of preventing the atmosphere from entering a heat-insulating container adapted to temporarily store a low-temperature liquefied gas, which is then dripped or allowed to flow down therefrom through a narrow flow path for use, comprising the step of constantly supplying a dry gas to the inside of the heat-insulating container when it is in an inoperative state in order to maintain inside the container a dry gas atmosphere having a pressure slightly higher than the atmospheric pressure.

According to the present invention, it is possible to reduce the amount of the low-temperature liquefied gas necessary for cooling down the heat-insulating container on resumption of use, since if the vaporized gas supply conduit pipe connected to the heat-insulating container is thermally insulated, a low-temperature vaporized gas is supplied to the container, thereby allowing the inside thereof to be maintained at a low-temperature.

The above and other objects, features and advantages of the invention will be apparent from the following description taken in connection with the accompanying drawing.

BRIEF DESCRIPTION OF THE DRAWING

The FIGURE is a schematic illustration of a preferred embodiment of the invention.

DESCRIPTION OF THE PREFERRED EMBODIMENT

A low-temperature liquefied gas 2, e.g., liquid nitrogen, in a low-temperature liquefied gas supply container 1 is supplied through a conduit 3 to a heat-insulating container 4, where the liquefied gas 2 is temporarily stored and then allowed to flow down or be dripped from a nozzle 5, disposed in the lower part thereof, for use. In practice, the supply of the liquid nitrogen is controlled by opening or closing a valve 6 provided to the conduit 3 in accordance with a signal sent from a level sensing element (not shown) for the liquid nitrogen, provided in the heat-insulating container 4, so that the level of the liquid nitrogen in the heat-insulating container 4 will be substantially constant. When the use of the liquid nitrogen is suspended, the supply of the liquid nitrogen is stopped by closing the valve 6. Therefore, when the liquid nitrogen remaining in the heat-insulating container 4 has all flowed out from the nozzle 5, the heat-insulating container 4 becomes empty, allowing the atmosphere to enter the container 4 through the nozzle 5 or the like. In order to prevent the entrance of the atmosphere upon interruption of the use of the liquid nitrogen, vaporized nitrogen gas 7 above the level of the liquid nitrogen in the supply container 1 is supplied to the heat-insulating container 4 through a conduit 8 and a valve 9. The supplied gas is released into the atmosphere from a gas discharge pipe 10, while maintaining the space in the heat-insulating container 4 in a nitrogen atmosphere. The liquid nitrogen remaining in the heat-insulating container 4 also all flows out, allowing the empty container 4 to be filled with the nitrogen gas. Since the nitrogen gas produced through vaporization of the liquid nitrogen includes no moisture at all, it is possible to maintain the inside of its heat-insulating container 4 in a dry state if the vaporized nitrogen gas is continuously supplied through the conduit 8. Moreover, there is no possibility of entrance of the atmosphere through the nozzle 5 or the gas discharge pipe 10, since the inside of the heat-insulating container 4 has a pressure slightly higher than the atmospheric pressure. Accordingly, even when there is no liquid nitrogen in the heat-insulating container 4, i.e., the container 4 is empty, pieces of ice and frost are prevented from clinging to the inner wall of the heat-insulating container 4 or the surface of the nozzle 5, thereby making it possible to avoid troubles resulting from blocking up the nozzle. Moreover, if the conduit 8 is thermally insulated, it is possible to maintain the inner wall temperature to be low even when the heat-insulating container 4 is empty, since the temperature of the supplied nitrogen gas will not rise much above the boiling point thereof, i.e., the gas is kept sufficiently low in temperature. Consequently, there is substantially no need for cooling down the heat-insulating container 4 when the liquid nitrogen is supplied to the heat-insulating container 4 through the conduit 3 on resumption of use of the liquid nitrogen. Therefore, it is also possible to advantageously reduce the amount of the liquid nitrogen necessary for the cooling down operation.

If a valve (not shown) is provided to the gas discharge pipe 10 and the latter is closed by the former, the nitrogen gas is released into the atmosphere only from the nozzle 5. Accordingly, the amount of the liquid nitrogen to be vaporized in the supply container 1 for carrying out the method of the invention is extremely small, so that there is no economical damage. Although the conduit 8 is directly communicated with the inside of the heat-insulating container 4 in the illustrated embodiment, this is not limited to the embodiment and the conduit 8 may be communicated with the conduit 3 on the downstream side of the valve 9 to supply the nitrogen gas therefrom to the heat-insulating container 4. Instead of using the vaporized nitrogen gas 7 in the supply container 1 as the nitrogen gas to be supplied to the heat-insulating container 4, it is possible that a part of the liquid nitrogen is branched off from the liquid nitrogen supply conduit 3 by means of a branch pipe and is vaporized by means of a heat exchanger which is provided to the branch pipe and employs an outside heat such as the atmosphere or stream as a heat source, and this vaporized nitrogen gas is supplied to the heat-insulating container 4. This is, however, not a very preferable method, since the outside heat enters the liquid nitrogen supply conduit 3. In the case where the heat-insulating container 4 is an open type container, i.e., a container open to air, it is only necessary to provide a valve to the gas discharge pipe 10 and open the valve in use as described above. On the other hand, in the case where the heat-insulating container 4 is a closed type container, it is only necessary to adapt the valve to be opened when there is a need for regulating the pressure in the heat-insulating container 4.

The method of the invention can be widely applied to heat-insulating containers adapted to temporarily store a low-temperature liquefied gas, which is then dripped or allowed to flow down therefrom through a narrow flow path which is easily blocked up, such as a nozzle.

The effects of the invention are summarized as follows:

(1) Since the inside of the heat-insulating container in an inoperative state is maintained in a dry atmosphere having a pressure slightly higher than the atmospheric pressure, the atmosphere does not enter through the openings. Consequently, pieces of ice and frost are not formed, and hence, there is no possibility of blocking up the low-temperature liquefied gas outlet port.

(2) It is unnecessary to separately provide a dry gas supply source, since the gas vaporized in the low-temperature liquefied gas supply container is employed as a dry gas.

(3) It is possible to reduce the amount of the low-temperature liquefied gas necessary for cooling down the heat-insulating container on resumption of use, since if the vaporized gas supply conduit pipe connected to the heat-insulating container is thermally insulated, a low-temperature vaporized gas is supplied to the container, thereby allowing the inside thereof to be maintained at a low-temperature.

(4) Since the amount of the vaporized gas supplied to the heat-insulated container is small, and since the supply of the vaporized gas involves the utilization of spontaneous evaporation of the liquid nitrogen in the supply container, there is no problem in cost.

(5) The whole apparatus will not be made complicated, since additional installations are only the heat-insulating conduit duct connecting the gas phases in the low-temperature liquefied gas supply container and in the heat-insulating container, the valve and so forth.

(6) Since the vaporized gas to be supplied to the heat-insulating container is a gas produced through vaporization of the low-temperature liquefied gas to be used in the container, the inside thereof is not contaminated, and hence, it is unnecessary to purge the inside of the container before use.

What is claimed is:

1. A method of operating apparatus comprising a supply tank containing low-temperature liquefied gas, a heat insulated container for temporary storage of low-temperature liquefied gas having a normally open outlet from which liquefied gas issues substantially constantly when the apparatus is in operation, and valved conduit means for supplying low-temperature liquefied gas from said supply tank to said container when the apparatus is in operation and whereby flow of liquefied gas from the supply tank to the container can be blocked to render the apparatus inoperative, said method being characterized by:

at substantially all times that the flow of liquefied gas to the container is blocked, supplying thereto vaporized gas of the same kind as said liquefied gas, at an above-atmospheric pressure and at a temperature near the boiling point of the liquefied gas, to thus maintain the interior of said container at a low temperature and free from water, carbon dioxide and air.

2. The method of claim 1 wherein said valved conduit means communicates with a bottom portion of said supply tank for supplying low-temperature liquefied gas therefrom to said container when the apparatus is in operation, further characterized by:

communicating said container with an upper portion of said supply tank when the flow of liquefied gas to the container is blocked, to thus provide for flow of vaporized liquefied gas to the container at said pressure and temperature.

3. The method of claim 1 wherein said vaporized gas is obtained by drawing a small flow of liquefied gas out of said supply tank and heating said small flow to vaporize it.

* * * * *